United States Patent [19]

Mlekodaj

[11] 4,157,471

[45] Jun. 5, 1979

[54] HIGH TEMPERATURE ION SOURCE FOR AN ON-LINE ISOTOPE SEPARATOR

[75] Inventor: Ronald L. Mlekodaj, Oak Ridge, Tenn.

[73] Assignee: United States Department of Energy, Washington, D.C.

[21] Appl. No.: 904,677

[22] Filed: May 10, 1978

[51] Int. Cl.[2] ..... H01J 27/00

[52] U.S. Cl. ..... 250/423 R; 250/427

[58] Field of Search ..... 250/423, 427

[56] References Cited

U.S. PATENT DOCUMENTS

| | | | |
|---|---|---|---|
| 2,978,580 | 4/1961 | Von Ardenne | 250/427 |
| 3,392,280 | 7/1968 | Friedman et al. | 250/423 |

*Primary Examiner*—Harold A. Dixon

*Attorney, Agent, or Firm*—Dean E. Carlson; Stephen D. Hamel; Louis M. Deckelmann

[57] ABSTRACT

A reduced size ion source for on-line use with a cyclotron heavy-ion beam is provided. A sixfold reduction in source volume while operating with similar input power levels results in a 2000° C. operating temperature. A combined target/window normally provides the reaction products for ionization while isolating the ion source plasma from the cyclotron beam line vacuum. A graphite felt catcher stops the recoiling reaction products and releases them into the plasma through diffusion and evaporation. Other target arrangements are also possible. A twenty-four hour lifetime of unattended operation is achieved, and a wider range of elements can be studied than was heretofore possible.

5 Claims, 2 Drawing Figures

HIGH TEMPERATURE ION SOURCE FOR AN ON-LINE ISOTOPE SEPARATOR

This invention was made in the course of, or under, a contract with the U.S. Department of Energy.

BACKGROUND OF THE INVENTION

An ion source for on-line use with a cyclotron heavy-ion beam, such as illustrated in FIG. 1 of the drawings, also known as the Integrated Target-Ion Source, is adapted to operate in an on-line mode with the Oak Ridge Isochronous Cyclotron (ORIC). The system of FIG. 1 is based on a modified Nielsen oscillating-electron ion source that receives a desired heavy ion beam from the ORIC and provides beams of radioactive products produced by the cyclotron beam interacting with a target foil.

The ion source of FIG. 1 essentially comprises a graphite cathode 1, a tungsten filament 4 coupled to an external power supply, not shown, by a pair of conductors 2 and 3, a quartz insulator 5, a graphite anode cylinder 6, another quartz insulator 5', and a graphite cathode 13 provided with an extraction hole. Mounted in a threaded hole 14 provided in the anode cylinder wall is a porous graphite-felt catcher 7, a tubular boron nitride extension 8 provided with a support gas feed tube 12 coupled thereto, a target foil 9 and a centrally apertured, graphite retainer 10, all mounted together as a unit and fitted in the threaded hole 14. p The foil 9 also serves as an isolation between the ion source plasma and the beam line vacuum. In operation, radioactive reaction products produced by the heavy-ion beam 11 from a cyclotron, not shown, interacting with the target foil 9, recoil out of the target foil 9 and are stopped in the porous graphite-felt catcher 7. With the catcher held at approximately the temperature of the ion source (1000° C.), the reaction products diffuse from the catcher into the ion source where they are ionized before extracted therefrom. The Integrated Target-Ion Source of FIG. 1 has been described in an article published in Nucl. Instra. Meth., 139, 299 (1976). The performance of the ion source of FIG. 1 has been satisfactory and indistinguishable from an operation ordinary Nielson source, but is no longer used in favor of the new design of the present invention to be described hereinbelow, which meets a need to provide an on-line ion source having an increased ionization efficiency for the more difficult to vaporize elements.

SUMMARY OF THE INVENTION

It is the object of the present invention to provide an improved ion source for on-line use with a cyclotron heavy-ion beam having an increased ability to ionize the more difficult elements.

The above object has been accomplished in the present invention by utilizing a tungsten filament of similar dimensions as the above prior art, utilizing a small anode axially extending into one end of the present ion source discharge chamber instead of an encompassing anode cylinder as was utilized in the above prior art, and substantially reducing the size of said source discharge chamber as compared to the prior ion source, thereby achieving a much higher operating temperature and resulting in an increase in the on-line ionization efficiency thereof and providing a means for effecting the ionization of the more difficult elements during the operation thereof.

DESCRIPTION OF THE PREFERRED EMBODIMENT

Figure 2:
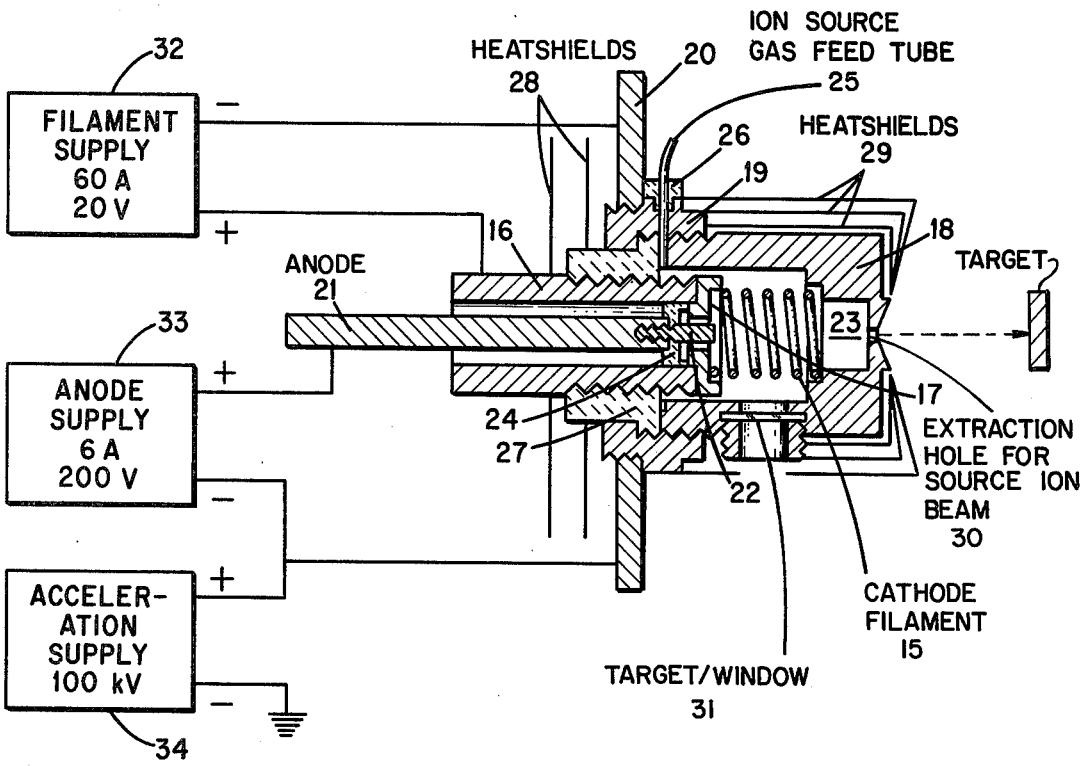
FIG. 2 is a sectional view of the ion source of the present invention, also for on-line use with a cyclotron heavy-ion beam.

The improved ion source of the present invention is illustrated in FIG. 2 of the drawings, which will now be described.

In FIG. 2, a helical tungsten, cathode filament 15 is mounted within a discharge chamber 23 formed by a hollow, graphite member 18 which is provided with an extraction hole 30 at one end thereof and with the other end being open. The open end of the member 18 is supported within an annular graphite support piece 19 which in turn is supported within a tantalum base plate 20. A hollow graphite tube 16 is provided, and the end thereof extends to within the chamber 23 through the open end of the member 18. The tube 16 is insulated from the support piece 19 by means of a boron nitride (BN) insulator 27 which abuts the open end of member 18. A centrally apertured tantalum washer 17 fits on the discharge chamber end of the tube 16 and the filament 15 bears against this washer and against the chamber 18 wall as shown in the drawing.

An elongated tantalum anode electrode 21 extends through the hollow tube 16 and is provided with a replaceable tip 22 which tip protrudes through the washer 17 into the discharge chamber 23 just within the filament 15. The electrode 21 with its tip 22 is insulated from the tube 16 by means of a boron nitride insulator 24. It can be seen in FIG. 2 that the discharge chamber forming member 18 closely encompasses the filament cathode 15 to thus provide the chamber 23 having a relatively small volume as compared to the device of FIG. 1. A plurality of heat shields 28 and 29 are provided which are mounted in any desired, conventional manner external to the ion source.

A source of support feed gas, not shown, is fed to the ion source of FIG. 2 by means of a stainless steel gas feed tube 25, for example, and the tube 25 is connected to the source through a BN insulator 26 to prevent its melting due to the high temperature operation of the source. The support feed gas fed to the ion source may be 0.5% zenon, 99.5% helium, for example, A thin tantalum foil, not shown, is inserted in the region between the graphite wall 18 and the insulator 27 to prevent their fusing together.

As shown in FIG. 2, an opening is provided in one wall of the graphite member 18 forming the discharge chamber 23, and a combined target/window 31 is mounted therein along with a thin graphite felt catcher on the discharge chamber side of the assembly. This assembly then receives a heavy ion beam, not shown, from a cyclotron, such as the ORIC, in the same manner as the device of FIG. 1, and the target/window 31 isolates the ion source plasma from the cyclotron beam line vacuum. The target/window foil 31 is selected from the group comprising Ir, Mo, Ta, W, and Ru, for example. The target material may be deposited directly on the graphite felt in some cases. A foil acting only as a window then is still required.

Current from a filament supply 32 is carried to the filament 15 through the tube 16 and the washer 17.

After passing through the filament 15, the current returns to the supply 32 (and ground) by traveling back through the member 18, the support piece 19, and the base plate 20.

An anode supply 33 is connected to the anode electrode 21 such that an arc plasma is created within the chamber 23 when the power supply 32 is connected to the filament 15 and the power supply 33 is connected to the anode electrode 21. An acceleration supply 34 is connected by means of the base plate 20 and the support piece 19 to the member 18, thus providing an acceleration voltage for the extraction of ions from the source chamber 23 through the extraction hole 30.

Figure 1:
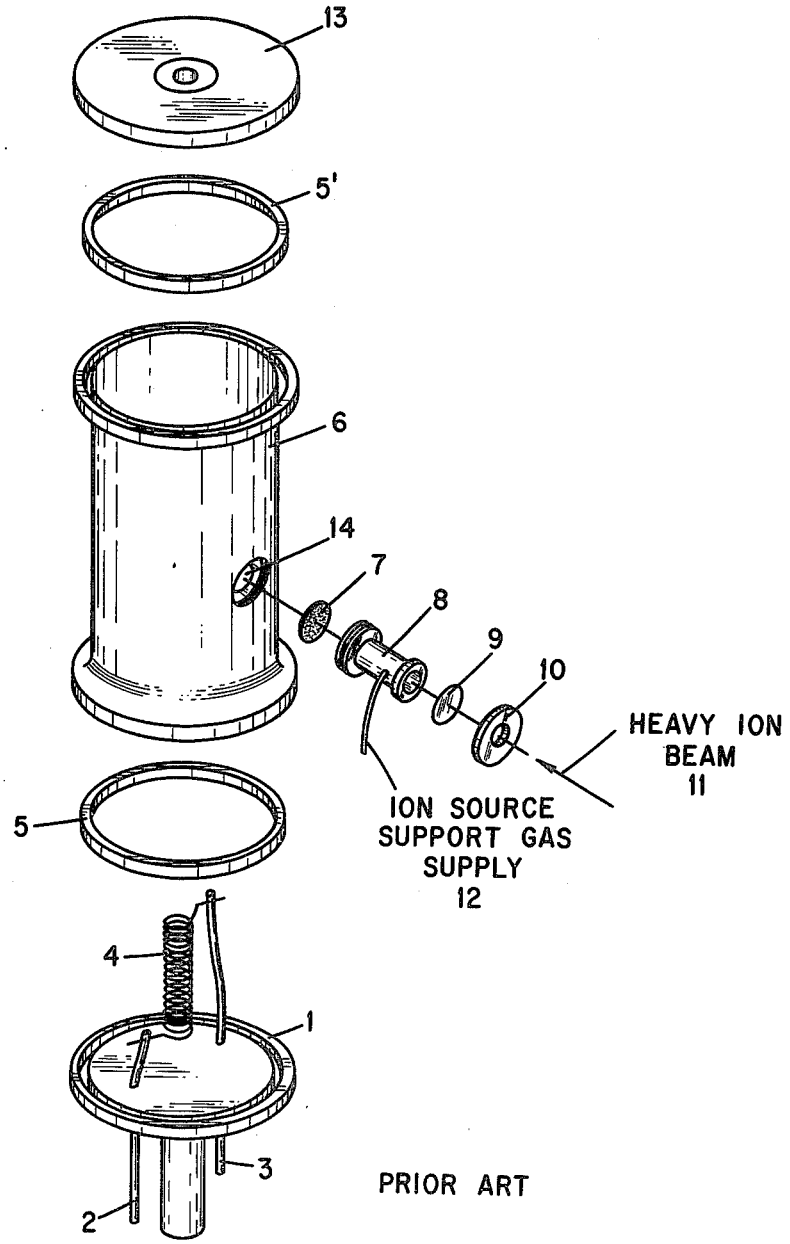
PRIOR ART Fig. 1
FIG. 1 is an isometric view of a prior art ion source for on-line use with a cyclotron heavy-ion beam.

It should be noted, as mentioned above, that the discharge chamber of FIG. 2 is much smaller than the discharge chamber of FIG. 1 (about one-sixth smaller), because of the different structural arrangements between the respective anodes and filaments of the two ion sources.

In the operation of the device of FIG. 2, beams of radioactive products are produced by the incoming cyclotron heavy-ion beam interacting with the target foil, and such products from the heavy-ion are stopped by the porous graphite-felt catcher. The reaction products diffuse from the catcher into the ion source where they are ionized by the source plasma, and the ionized products are then extracted through the hole 30, and then be utilized for nuclear research purposes, for example.

It should be noted that in the ion source of FIG. 2 and in the prior ion source of FIG. 1, the same filament and anode power inputs are utilized. However, since the ion source of FIG. 2 is about one-sixth the volume of the prior ion source of FIG. 1 an operating temperature of 2000° C. can be achieved for the device of FIG. 2 as compared to an operating temperature of 1000° C. for the device of FIG. 1.

The ion source of FIG. 2 operates in a very stable manner and can be left unattended, whereas the prior ion source of FIG. 1 requires constant attention. Also, the ion source of FIG. 2 can be operated about 24 hours at 2000° C. which is an excellent lifetime for a high temperature ion source.

The high temperature ion source of FIG. 2 has proven to be as good as the ion source of FIG. 1 for the easy-to-do (high vapor pressure) elements, and is applicable to many new elements because of its extended temperature range. It has a comparable on-line ionization efficiency for Hg. and substantially higher efficiencies for Tl, Pb, and Bi. In addition, 20-sec. $^{182}$Au has been observed with reasonable efficiency.

This invention has been described by way of illustration rather than by limitation and it should be apparent that it is equally applicable in fields other than those described.

What is claimed is:

1. A high temperature ion source for use with an on-line cyclotron comprising a metallic base plate, an annular graphite support piece fitted within said base plate, a hollow graphite member provided with an ion extraction hole at one end thereof and being open at its other end with said open end fitted within said support piece, the hollow interior of said member forming a discharge chamber, a hollow graphite tube extending within the open end of said hollow member, a metallic washer fitted against the extended end portion of said tube, a first insulator mounted between said support piece and said hollow tube and abuting the open end of said hollow member, a metallic filament mounted within said discharge chamber with one end thereof pressed against said washer and the other end thereof pressed against an interior wall of said chamber, the interior walls of said hollow member closely encompassing said filament to provide said chamber with a small volume, an elongated anode electrode extending through said hollow tube and provided with a replaceable tip, said tip extending through said washer, a second insulator mounted between said anode tip and the interior surface of said hollow tube, a gas feed tube coupled to said discharge chamber and adapted to supply support gas thereto, an opening provided in one wall of said hollow member, a combined target/window and graphite felt catcher mounted in said opening, a filament power supply source coupled to said filament, an anode power supply source coupled to said anode electrode, and an acceleration power supply source coupled to said hollow member, said opening with its target/window being adapted to be coupled to a selected heavy-ion beam from said cyclotron, whereby during operations of said ion source said heavy-ion beam will interact with said target foil to provide radioactive products which diffuse through said catcher into said chamber where they are ionized by the discharge plasma within said chamber before being extracted through said extraction hole.

2. The ion source set forth in claim 1, wherein said helical filament is tungsten, and said base plate, said anode electrode and its tip and said washer are tantalum.

3. The ion source set forth in claim 1, and further including a plurality of heat shields mounted on the exterior surfaces of said ion source.

4. The ion source set forth in claim 1, wherein said target/window foil is selected from the group consisting essentially of Ir, Mo, Ta, W, and Ru.

5. The ion source set forth in claim 1, wherein said ion source is adapted to operate unattended for 24 hours at a temperature of 2000° C.

* * * * *